United States Patent [19]

Brownlee

[11] Patent Number: 4,899,487

[45] Date of Patent: Feb. 13, 1990

[54] STORAGE AND DISPLAY RECEPTACLE ASSEMBLY

[76] Inventor: Richard W. Brownlee, 605 Derrick Rd., Spartanburg, S.C. 29378

[21] Appl. No.: 142,916

[22] Filed: Jan. 12, 1988

[51] Int. Cl.[4] ..... A47F 3/04

[52] U.S. Cl. ..... 47/41.01; 47/41.11; 47/79; 47/82

[58] Field of Search ..... 47/66, 68, 79–86, 47/39, 41 R, 41.11, 48.5

[56] References Cited

U.S. PATENT DOCUMENTS

| | | | |
|---|---|---|---|
| D. 188,990 | 10/1960 | Lowe | 47/39 X |
| 780,627 | 1/1905 | Umbehend | 47/66 |
| 863,620 | 8/1907 | Martens | 47/45 |
| 1,153,028 | 9/1915 | Chalk | 47/39 |
| 1,558,357 | 10/1925 | Henley | 47/66 |
| 2,005,966 | 6/1935 | Beagle | 47/41.13 |
| 2,261,326 | 11/1941 | Atkisson et al. | 47/41.11 |
| 2,463,719 | 3/1949 | Schackett et al. | 47/66 |
| 2,577,251 | 12/1951 | King | 47/41.13 |
| 2,830,406 | 4/1958 | McMurray | 47/41.11 |
| 3,183,624 | 5/1965 | Swett | 47/41.11 |
| 3,293,799 | 12/1966 | Keller et al. | 47/79 |
| 4,295,296 | 10/1981 | Kinghorn | 47/82 |
| 4,546,571 | 10/1985 | Scrivens | 47/66 |
| 4,608,776 | 9/1986 | Kooy | 47/41 R |

FOREIGN PATENT DOCUMENTS

| | | | |
|---|---|---|---|
| 2537135 | 2/1977 | Fed. Rep. of Germany | 47/79 |
| 3149102 | 6/1983 | Fed. Rep. of Germany | 47/39 |
| 62922 | 5/1864 | France | 47/83 |
| 415179 | 9/1910 | France | 47/39 |
| 1375650 | 9/1964 | France | 47/79 |

*Primary Examiner*—Robert A. Hafer
*Assistant Examiner*—Kevin G. Rooney
*Attorney, Agent, or Firm*—Dority & Manning

[57] ABSTRACT

An assembly for display and/or storage floral items or the like which includes a housing made up of stepped side walls, a rear wall, a front wall section at each step and top wall sections at each step. A container is located at each step, preferably received in an opening defined by the top wall section thereat. The containers define at least one water drain opening therein which is associated with a water drain system and with appropriate controls for maintaining water within the container or draining same therefrom. A water supply system is also provided in association with each container for supplying water thereto along with appropriate valving to control water supply to the containers. A cut item separator support may be provided within the containers for dividing the inside of the containers into a plurality of compartments for the receipt of floral items therein.

16 Claims, 5 Drawing Sheets

STORAGE AND DISPLAY RECEPTACLE ASSEMBLY

BACKGROUND OF THE INVENTION

The present invention relates to an assembly for the receipt of cut flowers, ferns, greenery or the like where the items received in the assembly are maintained in a proper environment for sustained display and/or storage.

At all levels of the floral business, whether grower, wholesale, retail or the like, quantities of cut flowers and other greenery are routinely maintained in-house for various and sundry purposes. Notably, at each level in the floral industry, it is necessary for the business to maintain significant quantities of cut flowers and greenery in inventory for either routine work in the preparation of floral arrangements or as inventory for resale to others. As is obvious, such floral items once cut from its living plant, thereafter will enjoy a limited useful life before wilting, or other deterioration to a point where the cut items cease to retain their freshness and beauty adequate for their intended purpose. In order to prolong the lifespan and preserve the beauty of these cut floral items, the industry has, in general, maintained the items in a body of water and further, when possible maintained the items in a refrigerated environment.

Further, at the grower level, the wholesale level, or the retail level, the maintenance of cut floral items in water and in a refrigerated environment coupled with transport of the items, replenishment of the water, and the like has been fraught with problems. Particularly, current handling techniques have historically involved the placement of a quantity of the cut floral materials into a bucket or other like container coupled with the manual removal of the items from the container when desired to pour out the water at periodic intervals and thereafter, replenish the supply of water and replace the items into the container. Furthermore, such handling has also involved the manual transport of the containers into and out of a refrigerated environment. Not only do the above exercises involve excessive labor due to the handling of multiple containers, but also repeated handling of the fragile cut floral items often leads to inadvertent damage to the product. Moreover, such handling techniques and placement of the cut floral items into a container with water re especially critical with certain floral items where a long stem is involved, and where the item is subject to bend or droop about the stem when not properly supported.

Since floral items are generally fairly expensive and are very fragile and subject to bruising, breakage of leaves or petals or the like, it is highly important that a system be available for use which will minimize the handling of the individual cut items as well as minimize the time involved in replacement of water, transport of the items into and out of the refrigerated environment and the like. Such improvements in the industry will not only lead to improved economy at the growing, wholesale and retail levels, but also will enhance the sustained beauty of the floral items and prolong the expected useful life of same. The present invention affords such a system, in that, there is provided for the use in a single assembly, or assembly module, a significantly increased capacity for receipt of cut floral items, an ability to maintain the items in the container at a desired or necessary disposition or attitude, an ability to replenish water in the container in a rapid and efficient manner, and an ability to move the cut items into and out of a refrigerated environment with little effort. Moreover, not only does the assembly of the present invention preclude the necessity of repeated handling of the cut floral items until they are intended to be sold or used in preparation of a floral arrangement, the assembly of the present invention likewise affords in addition to the above, an improved and effective display for floral items at a retail level.

Historically, as noted above, containers for storage and display, of cut flowers and other greenery have taken the form of buckets or like containers. Additionally, U.S. Pat. No. 1,764,543 to Barton discloses a flower table in which a plurality of stepped or terraced sections are provided having a series of circular openings along each shaft for receipt of potted plants, and with the steps being adjustable as to height to properly position the potted plants at a window for appropriate sunlight. Each of the stepped sections having the series of circular openings therein, has a trough located therebeneath to receive excess water as it drips from the pots with the troughs being elevationally adjustable at one end to permit drainage of water therefrom into an appropriate waste water receptacle. Additionally, U.S. Pat. No. 147,849 to Leslie shows a circular stand having stepped individual pot receiving elements therearound with appropriate drain connections between the pot receiving sections and a central column for discharge of the water. Likewise, a fountain is located at the top of the central column for water spray onto the potted plants. U.S. Pat. No. 4,006,559 to Carlyon, Jr. discloses a self-irrigating display rack for potted plants in which a series of circular shelves are located along a central column.

Still further, U.S. Pat. No. 3,365,840 to Cooper, U.S. Pat. No. 2,940,218 to Carter; U.S. Pat. No. 3,686,792 to Barfield; and U.S. Pat. No. 4,334,386 to Burcombe et al. each disclose arrangements, some of which are tiered, for hydroponic type growing systems or systems for supplying liquids to potted plants. It is submitted that the present invention is patentably distinct over the above-noted known prior art, and that the above patents neither individually nor collectively teach nor suggest same.

SUMMARY OF THE INVENTION

It is an object of the present invention to provide an improved assembly for storage and/or display of cut flowers, greenery and the like.

Another object of the present invention is to provide an improved assembly for receipt of cut flowers, greenery or the like in which items received therein may be subjected to an appropriate amount of water, and with facilities for adding water to the assembly or draining same as desired.

Still further, another object of the present invention is to provide an improved assembly for receipt of cut flowers, greenery or the like in which the items so received may be maintained in an appropriate wet environment as desired with the assembly being capable of maintaining the cut items in an appropriate disposition for protection of the items and having the capability of ease of transport.

Yet another object of the present invention is to provide an improved assembly in which cut flowers, greenery and the like may be received in a tiered arrangement and maintained to decrease the likelihood of damage to the items while in the assembly and with the assembly having the capability of adding water to receptacles for the cut items and/or draining water therefrom as desired.

Generally speaking, the assembly according to the present invention for storage and/or display of cut flowers, greenery or the like comprises a housing, said housing including opposite stepped side walls, a rear wall, a plurality of front wall sections, one of said front wall sections being provided for each step of said side walls, and upper wall sections provided at each step of said side walls, said upper wall sections being generally planar and having a container located thereat and extending down into said housing, said containers including a bottom wall and four side walls secured thereto and cooperating therewith to define an open compartment for receipt of said items, one wall of said containers defining a drain opening therein; means associable with said drain openings of said containers for drainage of water from said containers, said drain means including means to control drainage of water from said containers; and water supply means associable with said containers for providing water to said containers as desired, said water supply means including control valve means; and separator means located in said containers for separating said container compartment into sections of predetermined size.

More specifically, the display-storage assembly according to the present invention preferably includes a housing that is of unitary construction, preferably having been molded from fiberglass or some other reinforced polymeric material where the housing has a tiered construction on one side thereof and with the upper wall section of each step or tier defining an opening that covers a substantial portion of the area of the step or tier for receipt of a mating container therein. The container serves as a receptacle for the cut flowers or the like and is adapted for receipt of water as well as drainage of the water therefrom as desired. In a most preferred embodiment, the housing is preplumbed with appropriate piping leading to each of the containers at each of the tiers so as to present simultaneous or individual filling of the containers. Also, the containers preferably define a water drain opening in a bottom wall of same which is associated with a drain pipe which leads to a common manifold for all of the containers of the housing to permit water to be drained from each of the containers to a point exterior of the housing. The drain openings in the containers may be conveniently provided with a plug or stopper or, the drain lines may be provided with appropriate valving to control water drainage. In a further embodiment, the assembly can be provided with exterior water supply means and/or drainage means which are not permanently associated with the containers but which are usable for simultaneous filling and/or draining of the containers as well as individual container filling or drainage.

The housing for the present assembly is preferably solid along front and side walls with the top walls having the appropriate container receiver openings and with a rear wall having an appropriate open space therein to facilitate installation and/or maintenance of the plumbing to the housing. Furthermore, the housing is adapted for handling by forklift trucks or the like or for receipt on a wheeled dolly to afford ease of mobility of same and thereby ease of movement of a filled assembly into and out of the a refrigerated environment or within a work or display area.

Different cut flowers and greenery are preferentially provided at predetermined heights or stem length such that certain of the items will be quite short while others are quite lengthy. Further, many of the items to be received in the assembly of the present invention are somewhat more fragile and subject to bruising than other and require more delicate care. Of course, the taller the cut item, generally speaking, the more likely the item will bend along its length which also could detrimentally affect the product. Consequently, while containers of varying depths may be provided, one feature of the present invention is to provide a separator structure in the container which is adapted to appropriately maintain the particular cut items received therein. In one embodiment, the support structure assumes a general shape of the inside of the container with one or more elements extending across or along the length of the container which are movable along the support structure to provide a predetermined compartment size into which the particular cut items may be received. In another embodiment, the supporting structure defines a plurality of grid sections thereacross for receipt of smaller numbers of cut items and with a capability of vertical adjustment of the grid sections to accommodate varying lengths of cut items.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 8 is a cross-sectional view of a further embodiment of an assembly according to the present invention for storage and/or display of cut flowers, greenery or the like.

DESCRIPTION OF THE PREFERRED EMBODIMENTS

Figure 1:
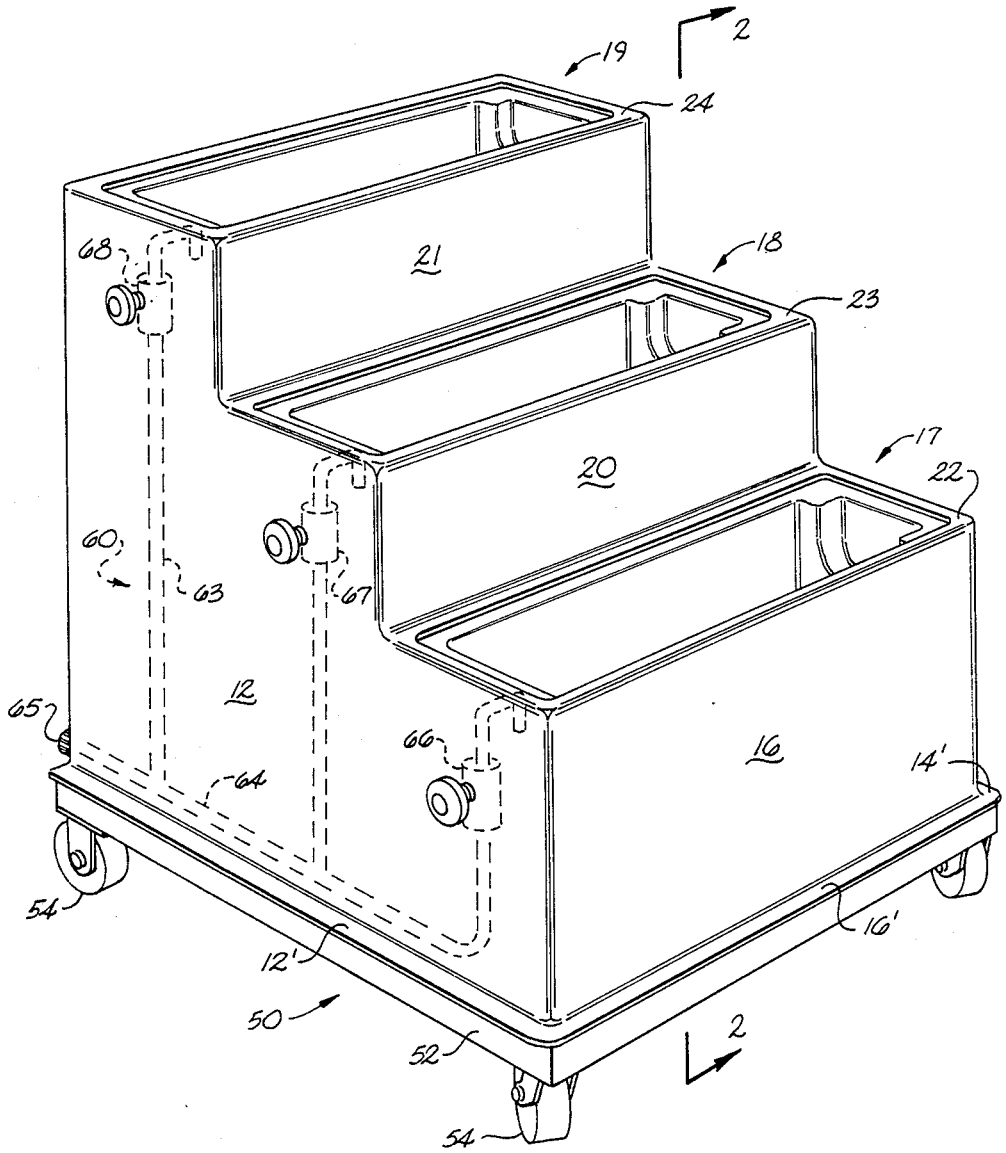
FIG. 1 is an isometric view of a preferred embodiment of an assembly for receiving cut flowers, greenery or the like according to the present invention.
Figure 2:
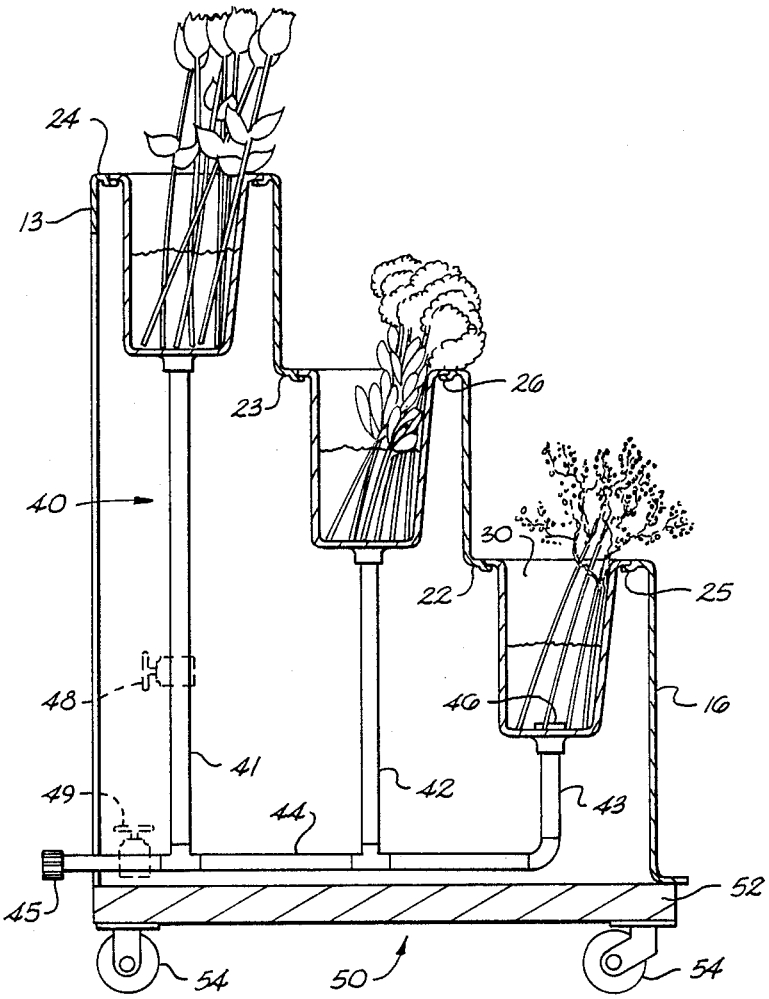
FIG. 2 is a cross-sectional view of the assembly as illustrated in FIG. 1, taken along the line 2—2 of FIG. 1.

Referring to the Figures, preferred embodiments of the present invention will now be described in detail. In FIGS. 1 and 2, as assembly generally indicated as 10 is illustrated. Assembly 10 includes a housing which is made up of opposite side walls 12 and 14, a rear wall 13 and a base front wall 16. Side walls 12 and 14 are tiered or stepped in shape to define, in part, steps or tiers generally indicated as 17, 18 and 19 atop assembly 10. Further front wall sections 20 and 21 are located between step sections 17, 18 and 19, respectively. Furthermore, step sections 17, 18 and 19 include top wall sections 22, 23 and 24, respectively, each of which preferably defines an opening therein that covers a major portion of the area of the individual top wall sections and which openings intended to receive a container 30 therewithin. Top wall sections 22, 23, and 24 of steps 17, 18 and 19 include a recessed ledge 25, 26 and 27, respectively, that borders that container receiving opening therein. Containers 30, in turn, include upstanding walls 32, 34, 36, and 38 all secured to a bottom wall 31 all of which cooperate to define an open receptacle within which cut flowers and the like may be received. An outwardly projecting lip or flange 33 is provided around the perimeter of the upstanding walls 32, 34, 36, and 38 such that when a container 30 is received within an opening of the top wall of one of the steps, ledge 33 extends down within the top wall 22, 23 or 24 and is received atop the ledge 25, 26 or 27 that surrounds the container receiving opening. Further, bottom wall 31 of container 30 preferably defines a drain opening 30 (shown in phantom in FIG. 1) and optionally may include a detent section 39 located in end wall 38 for purposes to be described hereinafter. An opposite end wall 34 of container 30 likewise defines a connection 35 to which a water supply line may be connected, though may simply define an opening in the wall for receipt of a water supply pipe therethrough.

As shown in FIGS. 1 and 2, three steps or tiers are provided on assembly 10 with a container received in the opening defined in the top wall of each. Moreover, as shown, a drain means generally indicated as 40 is provided within the housing and includes a plurality of pipes 41, 42 and 43 which are connected at an upper end to drain openings 37 of containers 30 and at a lower end to a common conduit or manifold 44 which exits the housing and is equipped with a connector 45 for union to a further drain line or the like, if necessary or desirable.

A rubber stopper or the like 46 may be received within drain opening 37 of container 30 (See FIG. 2) to maintain water within container 30 as desired, and which may be removed when it is desirable to drain same. In similar fashion, as is shown in phantom in FIG. 2, a valve means 48 may be provided on each of the upstanding pipes 41, 42 and 43 to permit control of drainage of the individual containers 30, or alternatively, should it be necessary or desirable that all of the containers 30 be simultaneously drained, as shown in phantom in FIG. 2, a single valve 49 may be provided along conduit 44.

A water supply system generally indicated as 60 and shown in phantom in FIG. 1 is likewise preferably provided within the housing of assembly 10 and includes upstanding pipes 61, 62 and 63 which are associated with containers 30 for supplying water thereto at one end and at an opposite end to a common manifold 64 which extends outwardly of assembly 10 and is provided with an adaptor 65 for attachment to a source of water. As shown, pipes 61, 62 and 63 extend into containers 30 through opening 35 and are not connected thereat. Each of upstanding pipes 61, 62 and 63 is provided with a valve means 66, 67 and 68, respectively, each of which includes an operating handle that is located outside the housing adjacent side wall 12. Water supply to each of the three containers 30 may thus be individually controlled from outside assembly 10.

As can be seen in FIGS. 1 and 2, side walls 12 and 14, rear wall 13 and base front wall section 16 of the housing of the assembly of the present invention have out turned flanges, 12', 13', 14' and 16', respectively, at lower ends of same. Such flanges permits the assembly 10 to reside in stable fashion on a wheeled dolly, generally indicated as 50, which will permit ease of transport of assembly 10 into and out of a refrigerated environment or about a work area as required within the establishment. Wheeled dolly 50 includes a platform 52, which while indicated as a solid structure may be skeletal so long as the appropriate structural requirements are met, with a castor 54 secured under each corner of same for additional support and mobility. In like fashion, while not illustrated, lower wall flanges 12', 13', 14' and 16' likewise facilitate the stable receipt of assembly 10 onto a pallet or other suitable surface which may be manipulated with a forklift or the like for transport. In fact, if assembly 10 is located above ground level adequate to permit the forks of a forklift to pass thereunder, assembly 10 may, per se, be handled by a forklift for transport.

Figure 4:
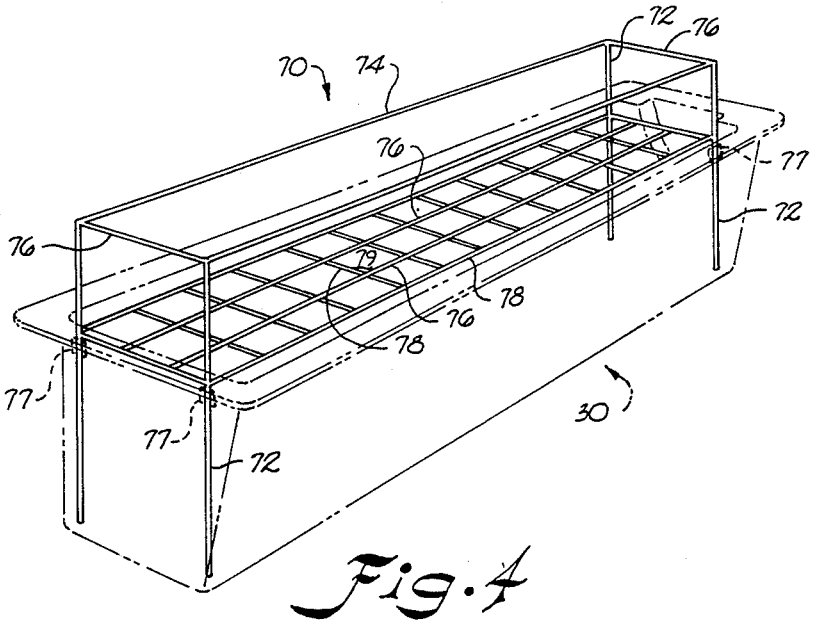
FIG. 4 is an isometric view of a container in phantom as generally illustrated in FIG. 3 and having a cut item support structure received therein.

Making reference to FIG. 4, a cut item support structure generally indicated as 70, is shown received within a container 30 and includes four vertical legs 72 to which are secured horizontal struts 72, 74 to form a generally rectangular skeletal support structure. Located intermediate the height of vertical legs 72 which as seen in FIG. 4, extend above the upper surface of container 30, are a plurality of horizontally disposed longitudinal and crossing elements 76, 78 which cooperate to define grid squares 79 within which small numbers of cut items may be placed. The intermediate grid square structure as defined by longitudinal elements 76 and crossing elements 78 may be secured at a particular location along the length of vertical strut 72, or may be adjustable along the length of same. As illustrated, stops 77 are frictionally received about vertical legs 72 which may be moved up and down same with the grid structure located atop same. Any other suitable adjustment arrangement may be provided, however. Particularly, as noted above, with certain cut floral items, it is desirable, if not necessary, that small quantities of same be segregated and supported along their lengths at a point where drooping or bending of the floral item about its stem will not occur to the detriment of the item, but where instead, the cut item will be maintained in an erect, standing position in container 30. Likewise, of course, a plurality of grid squares 79 further permits the introduction into container 30 of various species of cut floral items.

Figure 5:
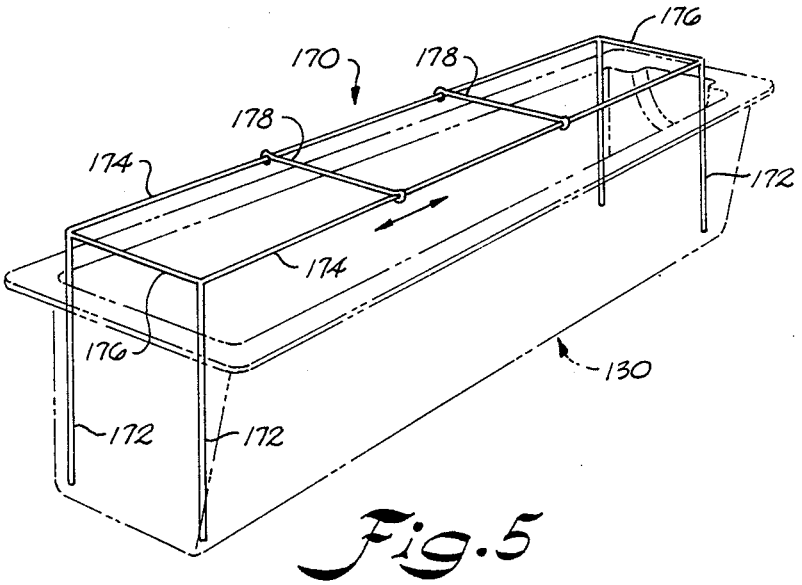
FIG. 5 is a further isometric view in phantom of a container generally as shown in FIG. 3, having a further embodiment of a cut item support structure received therein.

A further embodiment of a cut item support structure, generally indicated as 170 is shown in FIG. 5 being received within a container 130. In this embodiment, the support structure includes four vertical support legs 172 with appropriate upper struts 174, 176 being secured thereto to define the support structure. Additionally, cut item support structure 170 includes one or more divider elements 178 that are shown in FIG. 5 to span the space between upper struts 174 with elements 178 being wrapped therearound so as to slide along the parallel struts 174. In this fashion, with two such elements 178 shown, the cut item support structure may be divided into three separate segments of any desired length within the confines of the support structure 170. Obviously, while not shown, divider elements 178 could be secured between end struts 176 instead of longitudinal struts 174 as shown. With the cut unit support structure as shown in FIG. 5, a plurality of species of cut items could be received within the container 130 but with greater bulk within a separate area than is available with the structure shown in FIG. 4. Such occurs when either the height or the stability of the cut item does not present a problem of drooping of the cut item about its stem, or if so, where the divider elements 178 are moved in closely enough to cooperate with the height of vertical support elements 172 to preclude any such bending.

Figures 6, 7:
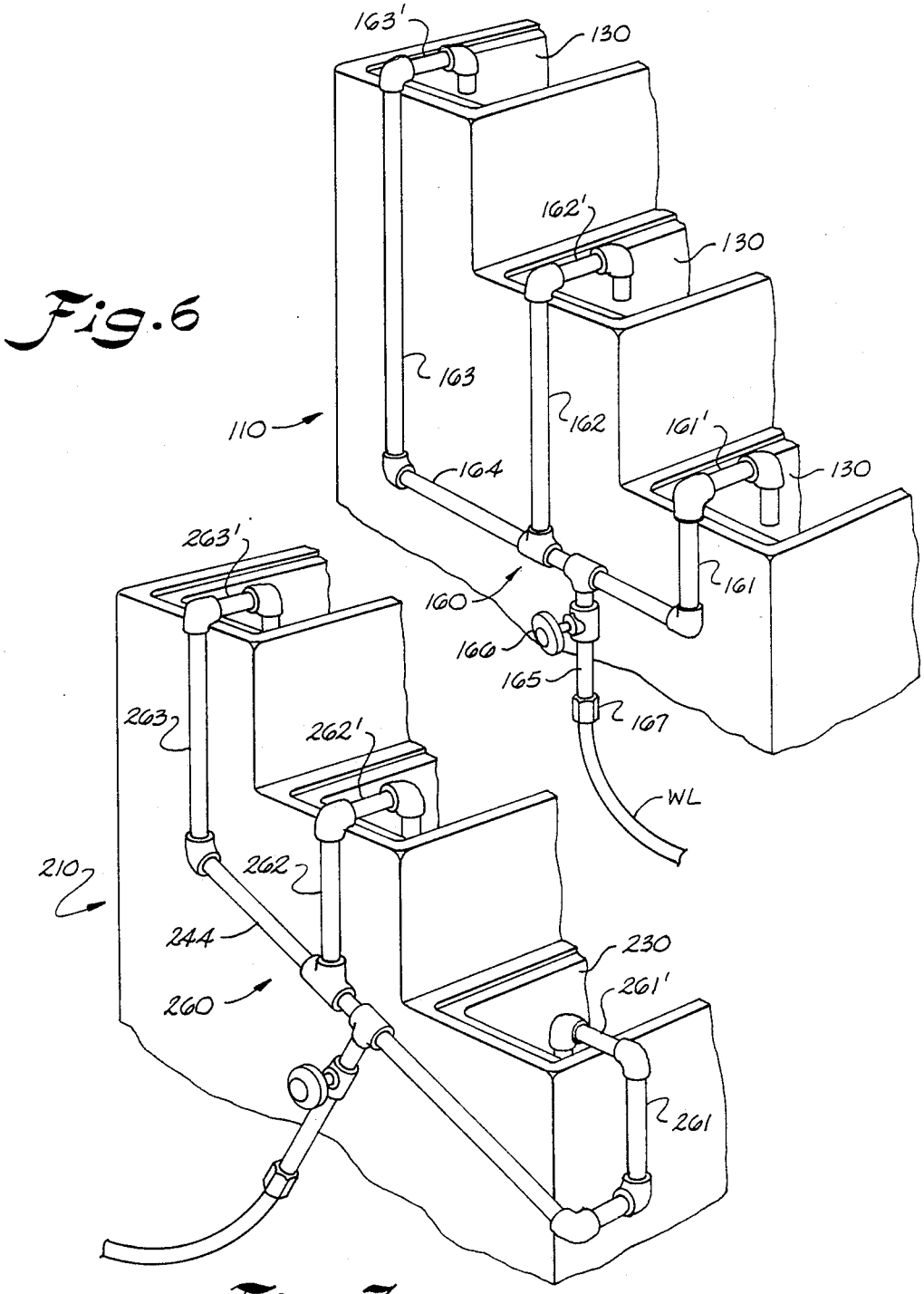
FIG. 6 is a partial isometric view of an assembly according to teachings of the present invention showing a further embodiment of a water supply system for use in conjunction therewith.
FIG. 7 is a similar view to that shown in FIG. 6 illustrating a still further embodiment of a water supply system for use in conjunction with an assembly according to the present invention.

As discussed with respect to FIGS. 1 and 2, where the water supply means was described as located internally of the housing of assembly 10, FIG. 6 illustrates a further embodiment of the present invention where an external water supply unit is provided which does not require preplumbing of the housing to accommodate same. FIG. 6 thus illustrates an assembly 110 with water supply means generally 160 located atop same, and with a water outlet extending into each container 130. Particularly, water supply means 160 includes a common conduit 164 to which vertical legs 161, 162, 163 are secured, each of which has a generally U-shaped outer free section 161', 162', 163', respectively, located at an upper end of same and with a leg of the U extending downwardly into the respective containers 130. Further, a downwardly extending leg 165 from common conduit 164 is provided with a valve 166 therein for control of water flow to all of the containers 130. A connector 167 is located at a lower end of water leg 165 for connection to a water line WL. With such an arrangement, water supply means 160 may simply be mounted atop assembly 110 and suspended therefrom. Actuation of valve 166 to permit water ingress to common manifold 164 will then direct water flow into each of the containers 30. With such an arrangement, since vertical leg 163 is longer than vertical leg 161, and with vertical leg 162 in between, it may be necessary to restrict flow through legs 161 and/or 162 to permit generally like flow into each of the three tiered containers 130. Such restriction could be made by way of an appropriate orifice (not shown). In like fashion, depending upon the needs of one using the assembly 110, container 130 into which vertical leg 163 feeds water may be lesser in depth than the other two containers by an appropriate amount such that all of the containers are filled simultaneously without the need of a restrictor in either lines 161 and/or 162. Likewise, if necessary, container 130 served by leg 162 would be lesser in depth than the containers for leg 161.

FIG. 7 shows yet a further embodiment of an exterior water supply means generally 260 for an assembly according to the present invention which represents yet another solution to at least partial equalization of water flow into the various containers. Particularly, a portion of an assembly 210 is illustrated having water supply means 260 shown supported thereon. Water supply means 260 includes, in like fashion to water supply means 160, a common conduit 244, with vertical legs 261, 262, and 263 secured thereto in fluid communication and with U-shaped sections 261', 262', and 263', respectively, located at upper ends of same. Differentially speaking, whereas common conduit 164 of FIG. 6 is illustrated in a basically horizontal position, it can be seen from FIG. 7 that common conduit 244 of water supply means 260 is angularly disposed such that there is less difference in height of legs 261, 262 and 263. Accordingly, if it is desired that a plurality of containers 230 being serviced thereby be filled simultaneously, restrictors would not be required in the lines. Since, however, water supply means 260 is provided with an angular common conduit 244, it is desirable in order to prevent inadvertent slippage away from the containers 230 that the U-shaped section 261' or one of the other U-shaped sections 262', 263' at the upper ends of the vertical legs of the water supply means be oriented to act as a stop means. As illustrated in FIG. 7, for example, common conduit 244 extends beyond the lower end of the lowermost container 230 with the U-shaped section 261' extending in a direction parallel to common conduit 244 such that the downward leg of the U of section 261', in the event of any slippage of the water means 260, would engage a portion of the container 230 in which it resides to preclude disengagement of the water supply means from the containers.

While the water supply means of FIGS. 6 and 7 show only a single water control valve, obviously either could include an individual valve for each of the legs, as shown in FIG. 1.

Figure 3:
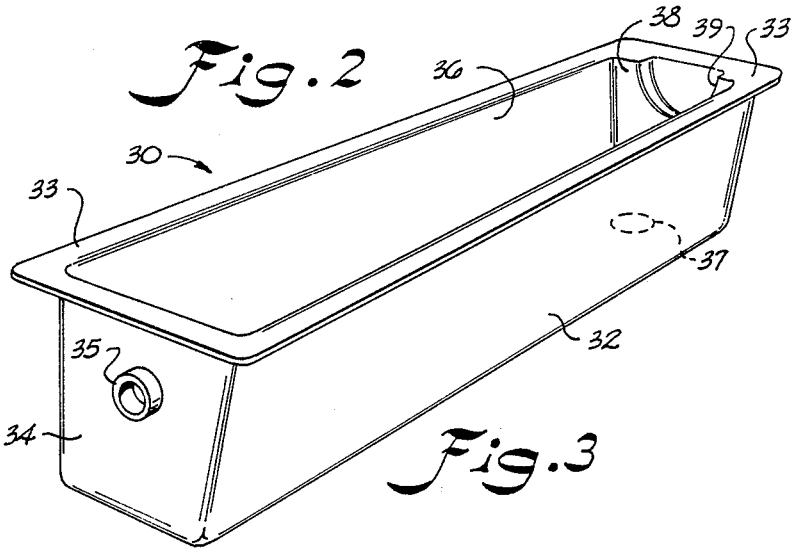
FIG. 3 is an isometric view of one embodiment of a container for receipt in an assembly according to the teachings of the present invention.
Figure 8:
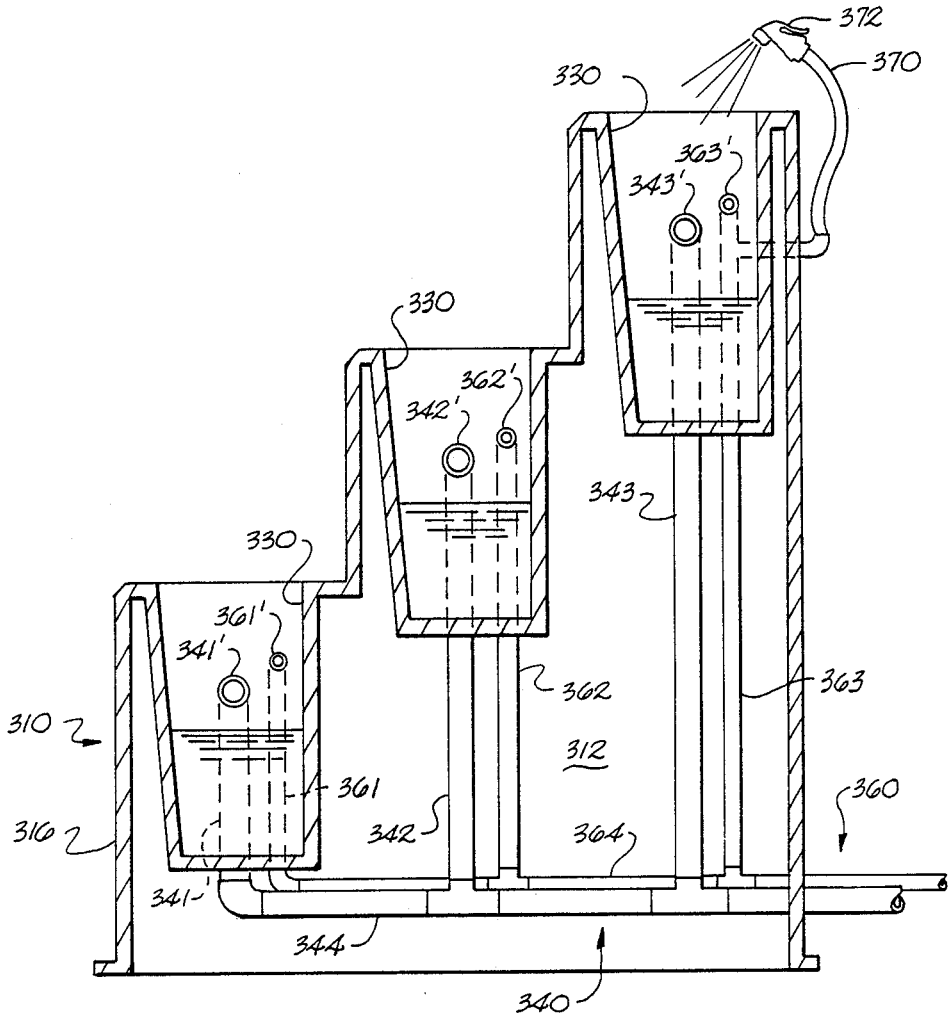

FIG. 8 shows yet a further embodiment of the present invention in which an assembly generally indicated as 310 is totally unitary in construction, including the various walls of the housing and the containers. As can be seen, front base wall section 316, side wall 312 and rear wall 313 are integral with the three tiered containers 330. Additionally, as can be seen, a water drain means generally 340 is provided along with a water supply means generally 360 in the same end of the containers 330. Water supply means 360 generally includes a common conduit 364 with vertical legs 361, 362 and 363 extending upwardly therefrom and extending into containers 330 at water outlets 361', 362' and 363'. Drainage means generally 340 on the other hand, includes a common drain conduit 344 with vertical legs 341, 342 and 343 being connected thereto with an upper end of same extending into containers 330 at openings 341', 342' and 343'. Water inlets to containers 330 at points 361', 362' and 363' are located at a level higher than drainage outlets 341', 342' and 343', and containers 330, as illustrated, do not contain a lower or bottom wall drainage outlet. With such an arrangement, drainage outlets 341', 342', and 343' serve as overflow drainage so as to permit water to be continually added to containers 330 until the water level reaches the drainage outlets 341', 342', and 343', at which point, of course, water would be drained from containers 330. Preferably, however, a bottom drain for each container is provided as illustrated in FIG. 2. Moreover, referring back to FIG. 3, an overflow drainage system could be located at detent 39 in end wall 38 of container 30. Additionally, as can be seen in FIG. 8, secured to upper water leg 363 is a flexible hose 370 with a spray nozzle 372 located at an outer end of same. Nozzle 372 can be utilized to spray cut items received in any of the containers 330 if desirable or necessary.

Assemblies according to the present invention can be provided in any desired length. A three foot long unit is, however, believed to be a preferred length to permit same to contain a suitable quantity of cut items while being able to be moved through a standard door jamb. Assemblies according to the present invention also serve well in a retail environ to display cut flowers for sale to consumers, and when provided with a wheeled dolly, or a wheel support secured to the hosing, can be easily rolled back and forth from refrigerated storage to the location in the store where the display is to be located.

While a number of different embodiments of different aspects of the present invention have been described hereinabove, it should be pointed out that any of the various embodiments may be interchanged with other of the various embodiments as desired to provide a particular unit structure.

It will be understood, of course, that while the form of the invention herein shown and described constitutes preferred embodiments of the invention, it is not intended to illustrate all possible form of the invention. It will also be understood that the words used are words of description rather than of limitation and that various changes may be made without departing from the spirit and scope of the invention herein disclosed.

What is claimed is:

1. An assembly for display and storage of cut flowers, greenery and the like comprising:

(a) a housing, said housing including opposite side walls, said side walls being stepped, a rear wall, a plurality of front wall sections, one of said front wall sections being provided for each step of said side walls, and upper wall sections provided at each step of said side walls, said upper wall sections being generally planar and defining an opening therein that includes at least a major portion of the area carried by said upper wall sections;

(b) a container receivable in each of said upper wall openings and extending down into said housing, said containers including a bottom wall and four side walls secured thereto and extending upwardly therefrom and cooperating therewith to define an open compartment for receipt of said items, at least certain of said side walls having a flange secured thereto and extending outwardly therefrom for contact with portions of said upper wall about said opening, said bottom wall of said containers defining a drain opening therein;

(c) means associable with said drain openings of said containers for drainage of water from said containers, said drain means including means for control of drainage from said container; and (d) water supply means associable with said containers for providing water to said containers as desired, said supply means including control valve means;

(e) separator means receivable in said containers for separating said container compartments into sections.

2. An assembly as defined in claim 1 wherein said rear wall of said housing defines an access opening therein and wherein said drain means compresses a length of conduit associated with each said container drain opening and a common drain manifold connected to said conduits, and wherein a stopper is provided for said drain opening to control drainage from said containers.

3. An assembly as defined in claim 1 wherein said water supply means comprises a common header adapted for connection to a source of water and a plurality of individual legs connected to said common header at one end and associated with one of said containers at an opposite end and valve means for controlling supply of water to said containers.

4. An assembly as defined in claim 1 wherein said separator means are adjustable.

5. An assembly as defined in claim 2 wherein said water supply means is generally located within said housing and comprises a common header, a conduit for each container associated at one end with said common header and at an opposite end with its respective container, and valve means for each container leg to permit control of water supply to each of said containers.

6. An assembly as defined in claim 1 comprising further:

(a) a support stand for said housing, said stand being adapted for reception of a bottom of said housing thereon, and a plurality of casters associated with said support stand for rolling transport of said receptacle.

7. An assembly as defined in claim 1 wherein said water supply means comprises a common header adapted for association with a source of water and a supply leg for each container secured at one end to said common header and having a free outer end, said free outer ends of said legs being adapted for receipt about said housing side walls and into said respective containers, and valve means for controlling water flow into said containers.

8. An assembly as defined in claim 7 wherein a single valve means is provided for controlling flow to all of said containers simultaneously.

9. An assembly as defined in claim 1 wherein said housing and said container are constructed of reinforced polymeric material.

10. An assembly for receipt of floral items and the like comprising:

(a) a housing, said housing including opposite side walls having stepped upper surfaces, a rear wall extending between said side walls, a front wall section extending between said side walls at each step and upper wall sections extending between said side walls at each step;

(b) a container located at each step and extending down into said housing, said containers defining drain openings therein;

(c) water drain means associated with said container drain openings for removal of water therefrom, said drain means including control means; and (d) water supply means associated with said containers for supplying water thereto, said water supply means including valve means for control of water supply to said containers.

11. An assembly as defined in claim 10 wherein each of said upper wall sections defines an openings therein and said containers are received in said openings.

12. An assembly as defined in claim 10 wherein said housing and said containers are of unitary construction.

13. An assembly as defined in claim 10 wherein said drain means is located within said housing and comprises a common conduit with legs secured between said drain openings in said containers and said common conduit and wherein stoppers are provided to seal said drain opening when desired.

14. An assembly as defined in claim 10 wherein said water supply means comprises a common conduit with legs secured thereto and extending upwardly to each container, each leg having a valve means associated therewith.

15. An assembly as defined in claim 14 wherein said water supply means is located within said housing.

16. An assembly as defined in claim 14 wherein said water supply means is located exterior of said housing and said legs to said containers include a U-shaped section at outer ends of same.

* * * * *